US005700232A

United States Patent [19]

Clausen et al.

[11] Patent Number: 5,700,232

[45] Date of Patent: Dec. 23, 1997

[54] EXERCISE APPARATUS

[75] Inventors: Anthony Robin Clausen, 7 Klip Street, Observatory, Johannesburg; Albert Norman Wesson, Germiston, both of South Africa

[73] Assignee: Anthony Robin Clausen, Johannesburg, South Africa

[21] Appl. No.: 737,915

[22] PCT Filed: May 23, 1995

[86] PCT No.: PCT/GB95/01178

§ 371 Date: Nov. 22, 1996

§ 102(e) Date: Nov. 22, 1996

[87] PCT Pub. No.: WO95/32027

PCT Pub. Date: Nov. 30, 1995

[30] Foreign Application Priority Data

May 23, 1994 [ZA] South Africa ..... 94/0655
Apr. 4, 1995 [ZA] South Africa ..... 95/2738

[51] Int. Cl.[6] ..... A63B 21/02

[52] U.S. Cl. ..... 482/125; 482/126; 482/129

[58] Field of Search ..... 482/129, 123, 482/121, 122, 126, 125, 132, 130

[56] References Cited

U.S. PATENT DOCUMENTS

| | | | |
|---|---|---|---|
| 3,465,592 | 9/1969 | Perrine . | |
| 3,498,609 | 3/1970 | Lukens | 482/125 |
| 5,039,092 | 8/1991 | Olschansky et al. | 482/130 |
| 5,222,927 | 6/1993 | Chang . | |
| 5,279,530 | 1/1994 | Hess . | |
| 5,295,935 | 3/1994 | Wang | 482/126 |
| 5,480,367 | 1/1996 | Bergman | 482/126 |

FOREIGN PATENT DOCUMENTS

| | | |
|---|---|---|
| 0413870 | 2/1991 | European Pat. Off. . |
| 3800035 | 7/1989 | Germany . |
| 161282 | 4/1921 | United Kingdom . |
| 2147513 | 5/1985 | United Kingdom . |
| 2249487 | 5/1992 | United Kingdom . |

*Primary Examiner*—Lynne A. Reichard

*Attorney, Agent, or Firm*—Jacobson, Price, Holman & Stern, PLLC

[57] ABSTRACT

An exercise apparatus comprises an elongate hollow post formed from three interconnectable tube sections. A carriage is mounted slidably to the post, and a pair of handlebars extend transversely from the carriage. A pair of footrests is arranged to be selectably mounted at either end of the post for providing support against movement of the carriage, and a plurality of resistance elements such as rubber bands extend between the carriage and an anchor formation within one of the tube sections. The rubber bands pass around a pulley formation at one end of the post, and selector means are provided on the carriage for allowing a preselected number of the elastic bands to be engaged for varying the overall resistance of the carriage as it is displaced along the post. In use, the footrests are pivotably mounted to a selected end of the post so as to allow the post to pivot freely in a vertical plane when supported on the footrests. The length of the post may be varied by selecting the number of tube sections making up the post.

14 Claims, 8 Drawing Sheets

1
16
48
49
44
48
42
47
18
49
40
47
12
12.1
24
34
29A
30
29
28A
30A
32
28
34
168
32
29
26
14.1
29A
26A
62
62
12.2
10
12
14.2
42A
12.3
22
20
52
36A
36B
44A
40A 16
36
42
48
46
48
44
40
47
102
10
12.1
121
112
24
26
29
28
14.1
12.2
12.3
66
52
22
20
66
14.2
40A
62
42A

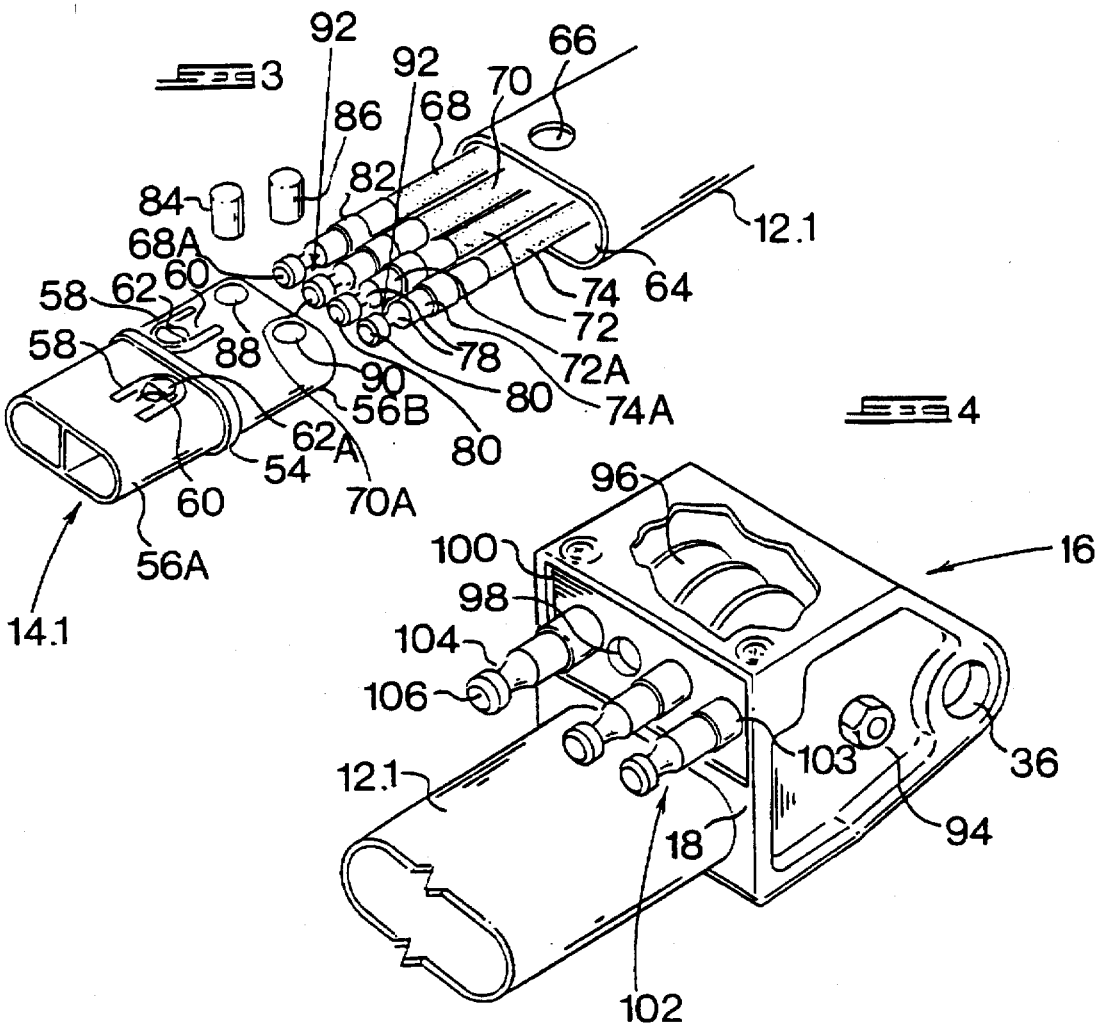
3
92
92
66
86
68
70
82
84
68A
60
12.1
58
62
74
64
72
58
88
78
72A
90
80
74A
56B
62A
80
54
70A
60
56A
14.1
4
96
16
100
98
104
106
103
36
12.1
94
18
102
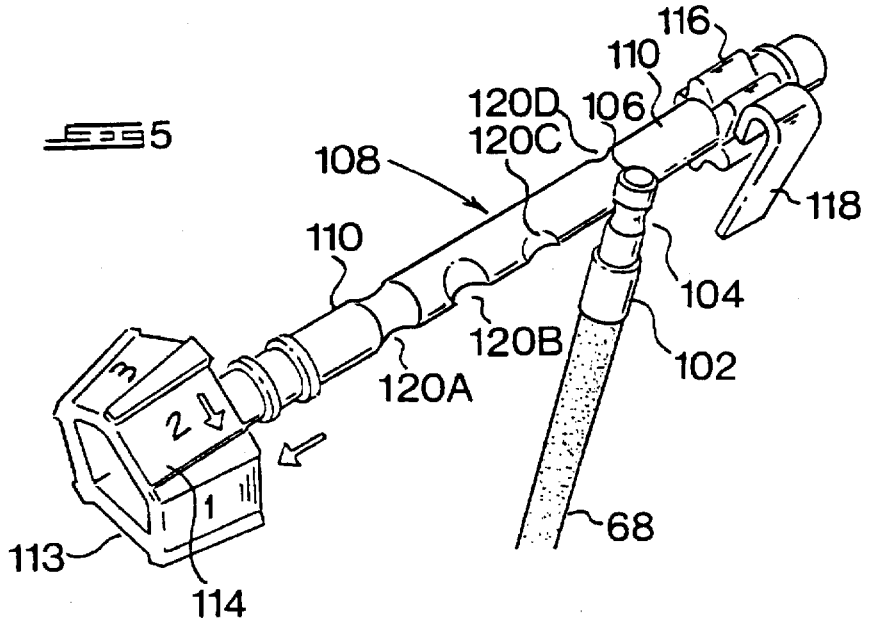
5
116
110
120D
106
120C
108
118
110
104
120B
102
120A
3
2
1
68
113
114

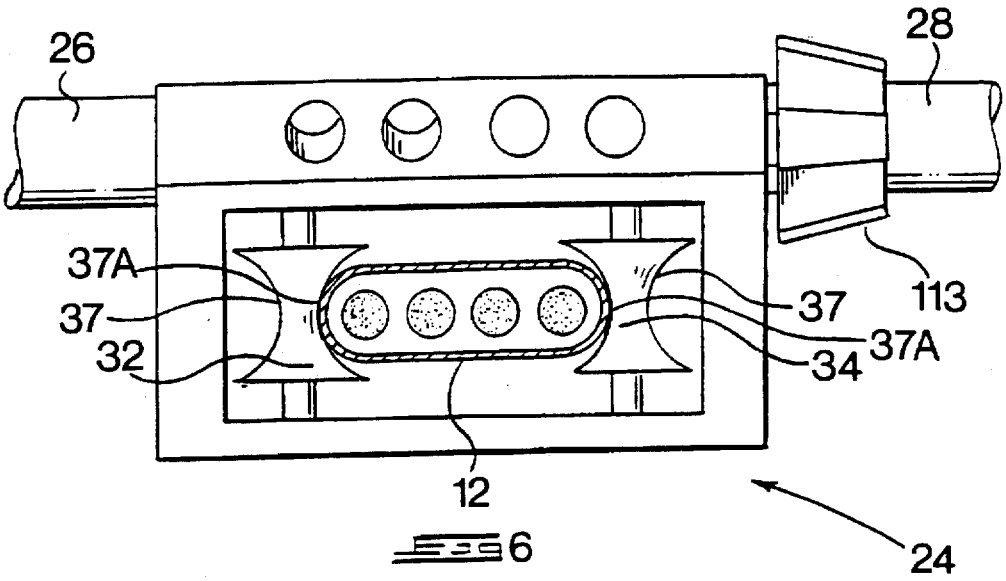
FIG. 6
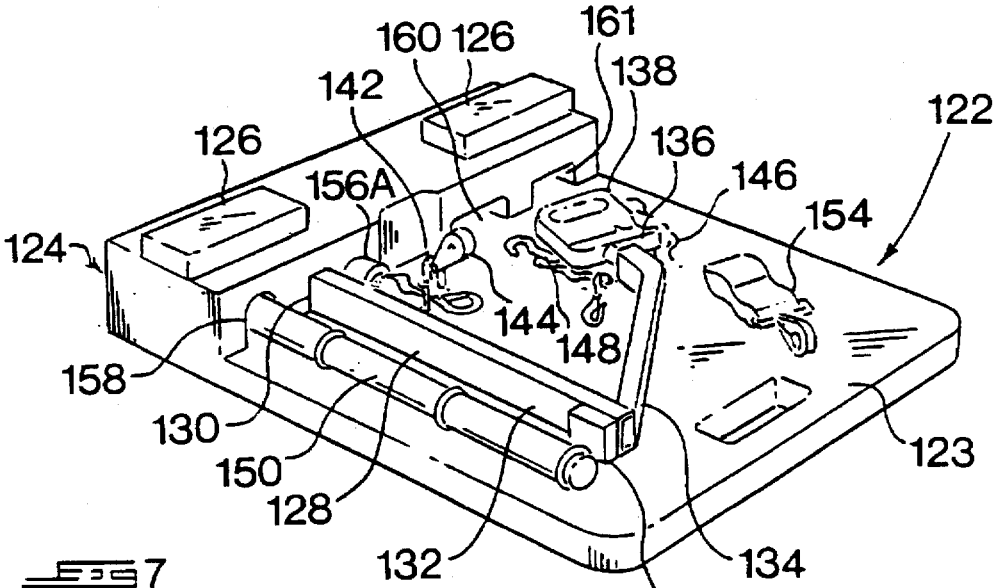
FIG. 7
FIG. 7A
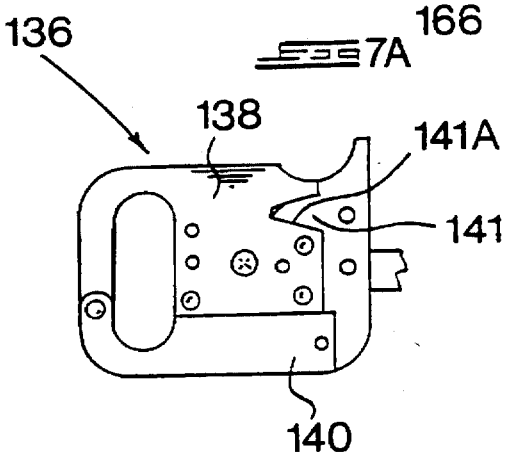

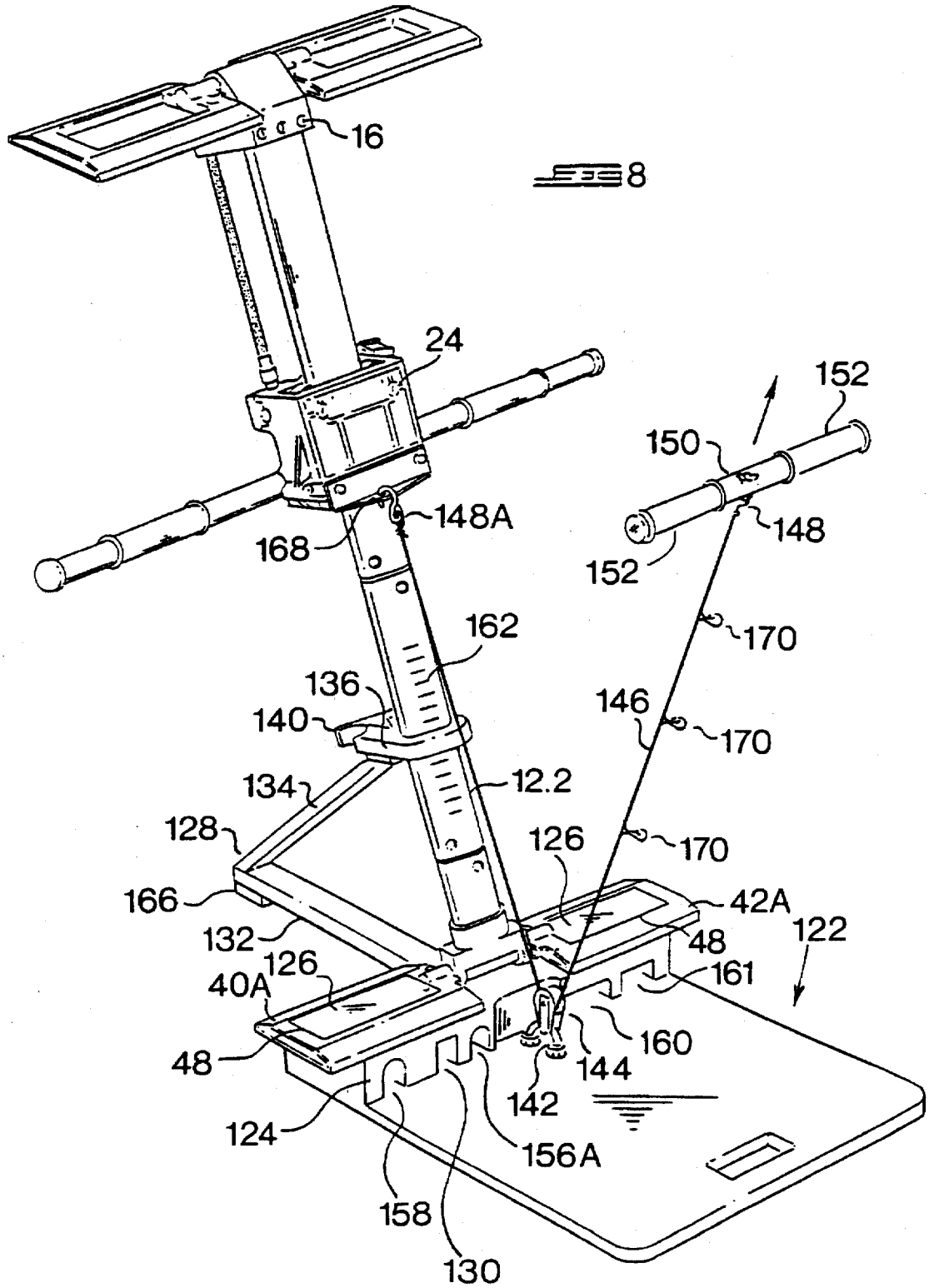
16
8
24
152
150
148A
148
168
152
162
170
136
146
140
170
134
12.2
128
126
170
166
42A
132
48
122
126
161
40A
160
48
144
142
124
156A
158
130

EXERCISE APPARATUS

BACKGROUND TO THE INVENTION

This invention relates to an exercise apparatus.

A large variety of home exercise equipment is currently available. This varies from complete home gyms, which include relatively unwieldy and expensive weight-based exercising equipment, to light, portable and relatively cheap exercising devices, such as the Bullworker®, which are often limited as regards the range of exercises that can be performed on them.

One common type of home gym apparatus is in the form of an inclined sliding bench which relies on springs and/or body mass for exercising the various muscle groups. The inclined bench-type apparatus has limitations as regards portability. Further, although different spring combinations are possible for providing different resistive forces, the selection and adjustment of the springs is typically a relatively laborious process.

German Patent No. DE 3800035A1 discloses an exercise apparatus comprising an elongate spacer element in the form of a pair of spaced apart poles which serve as guides for a pair of carriages which are mounted slidably to the poles. Each of the carriages supports a handlebar, and a series of elastic bands are anchored to the handlebars and extend around pulleys at opposite ends of the exercise apparatus. The elastic bands are used to provide a resistive force against movement of the carriages along the poles. A pull compensation bar extends transversely through apertures in the poles, and can be used to vary the effective length and thus the tension in the elastic bands. Anchoring means in the form of a ceiling hook or a wall plate may be mounted to either end of the apparatus for enabling it to be mounted to a fixture such as a ceiling or a wall. This enables either a pushing or a pulling force to be applied to the handlebar against the variable resistive force.

According to a first aspect of the invention there is provided an exercise apparatus comprising an elongate spacer element having first and second ends, guide means extending along the length of the spacer element, a carriage mounted slidably to the spacer element for movement between the first and second ends along the guide means, at least one handlebar supported on the carriage, resistance means for applying a resistive force against movement of the carriage as it is displaced long the spacer element in a first direction, the resistance means comprising a plurality of elastic resistance elements extending between the carriage and a fixture on the spacer element, varying means for varying the resistance of the resistive force, and anchoring means mountable to either of the first and second ends for enabling either a pushing or a pulling force to be applied to the handlebar against the variable resistive force when moving the carriage in the first direction characterised in that selector means are mounted on the carriage for selectively engaging with or disengaging from the carriage a preselected number of resistance elements, the anchoring means include at least one footrest extending transversely relative to the spacer element from whichever of the first and second ends is selected, and the footrest or footrests define a pivot axis and are arranged to provide a temporary anchoring support against movement of the handlebar when the feet of a user are positioned over the footrest or footrests, so as to allow the elongate spacer element to pivot in a substantially vertical plane about the pivot axis at its first or second ends, as the handlebar is moved in the first direction against the variable resistive force.

In a preferred form of the invention, the resistance means comprises a plurality of resistance elements extending between the carriage and a fixture on the spacer element, and selector means for allowing a preselected number of the resistance elements to be engaged for varying the overall resistance of the carriage as it is displaced along the spacer element.

Preferably, first and second mounting means are provided on the first and second ends of the spacer element for detachably mounting the at least one footrest.

Typically, the at least one footrest comprises a pair of footrests which extend transversely relative to the spacer element and which are pivotably mountable to the mounting means so as to allow the spacer element to pivot freely in a vertical plane when supported on the footrests.

Conveniently, the spacer element comprises a centrally aligned hollow post, the length of which is adjustable.

Advantageously, the hollow post comprises a plurality of tube sections, and connector means for detachably mounting together the tube sections, whereby the length of the post may be varied by selecting the number of tube sections to make up the post.

Preferably, the tube sections comprise first, second and third tube sections, and the respective connector means comprise first and second double spigot connectors, each spigot connector carrying a pair of sprung stud formations which are arranged to engage detachably with complemental apertures in the respective tube sections in a snap fit.

In one form of the invention, the fixture comprises anchoring means located within the spacer element for anchoring fixed ends of the resistance elements, and the spacer element carries direction changing means for changing the direction of the resistance elements between the anchoring means and the carriage.

The direction changing means typically comprises a pulley assembly mounted to the first end of the spacer element, the pulley assembly including a pulley housing, a plurality of pulleys mounted rotatably within the housing and a plurality of apertures defined in the housing through which movable ends of the resistance elements are presented for selective engagement with the selector means.

In one form of the invention, the selector means comprises an anchoring shaft which is mounted rotatably within the carriage, indexing means for indexing rotary movement of the shaft, and radially offset disengaging of engaging formations extending along the length of the shaft for selectively engaging or disengaging the movable ends of the resistance elements as the shaft is rotated.

Typically, the radially offset disengaging formations comprise a series of release grooves extending transversely relative to the axis of the anchoring shaft, and each of the movable ends of the resistance elements terminate in a head, with a narrowed neck portion being located rearwardly of the head, and being dimensioned to be anchored by the shaft, each head and release groove being complementally dimensioned such that a particular head is released on rotation of the corresponding release groove into axial alignment with the head.

In an alternative form of the invention, the selector means comprises a series of slot formations extending from the carriage, and each of the resistance elements terminate in an integrally formed bulbous head from which a gripping tag extends for selectively engaging at least one of the heads behind a corresponding slot formation.

In order that the invention may be better understood, several embodiments thereof will now be described by way of example only and with reference to the accompanying drawings in which:

FIG. 3 shows a detailed exploded view of an anchoring formation for anchoring the ends of elastic bands within a post;

FIG. 4 shows a partly cut-away perspective detail of a pulley assembly;

FIG. 5 shows a partly cut-away perspective view of a rotary selector mechanism supported on the carriage;

FIG. 6 shows a partly cross-sectional top plan view of the carriage;

FIG. 7 shows a base plate assembly forming part of a second embodiment of an exercise apparatus in a stowed position;

FIG. 7A shows a detailed top plan view of a clamping formation;

FIG. 8 shows a perspective view of the second embodiment of an exercise apparatus of the invention incorporating the exercise apparatus of FIG. 1 and the base plate assembly of FIG. 7;

DESCRIPTION OF EMBODIMENTS

Figure 1:
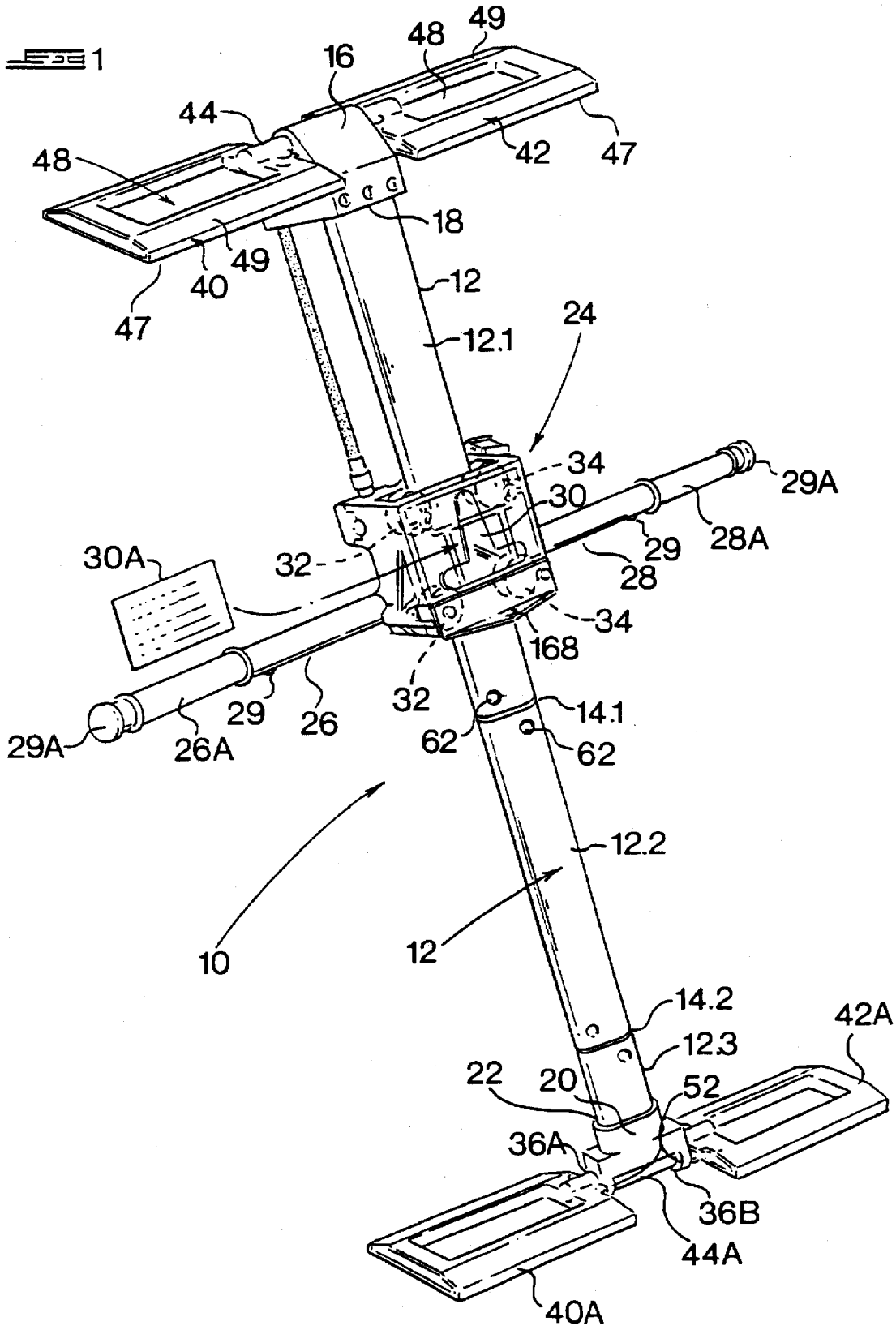
FIG. 1 shows a front perspective view of a first embodiment of an exercise apparatus of the invention.
Figure 2:
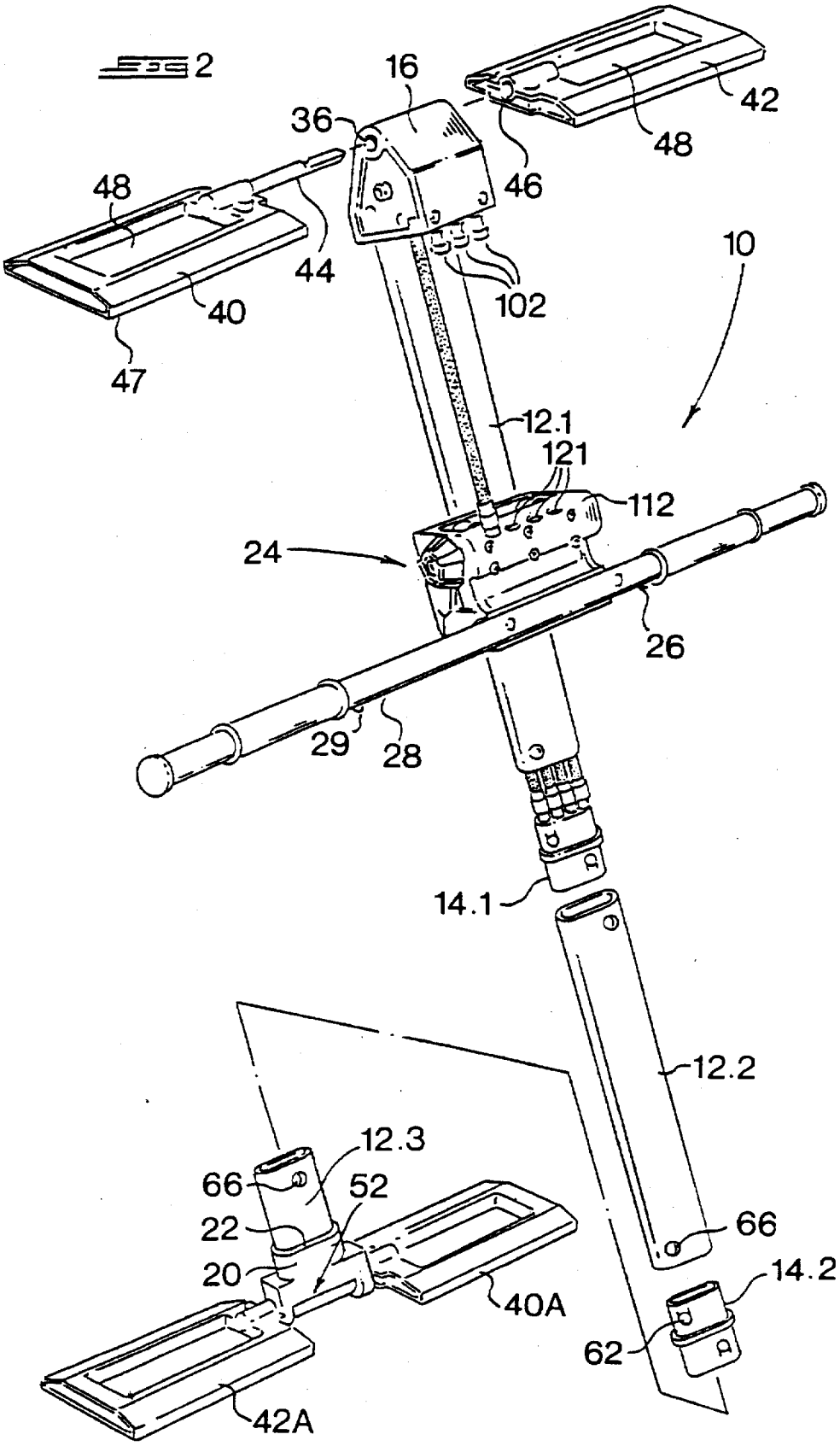
FIG. 2 shows a rear exploded view of the exercise apparatus of FIG. 1.

The exercise apparatus 10 illustrated in FIGS. 1 and 2 comprises a main tubular post 12 formed from upper, intermediate and lower tube sections 12.1, 12.2 and 12.3 which are held together by double spigot connectors 14.1 and 14.2. The tube section 12.1 terminations at its upper end in a pulley housing 16 which has an innermost planar at land 18 defining a first stop formation. The lower tube section 12.3 of the post terminates in an end connector 20 defining a second stop formation 22.

A carriage 24 supports a pair of handle bars 26 and 28 which extend transversely relative to the post 12. Tubular handles 26A and 28A are mounted rotatably to the respective handlebars. Spring loaded limit pins 29 are carried midway along each handlebar, and retain the handles selectively in an inward position adjacent the carriage or an outward position adjacent end bosses 29A. A transparent T-shaped retaining clip 30 is rivetted to a front face of the carriage for retaining an exercise card 30A incorporating details of a particular exercise routine for easy reference by the exerciser.

Opposed pairs of rollers 32 and 34 are mounted rotatably to the carriage housing, and as is clear from FIG. 6, each roller is formed with a concave bearing surface 37 which compliments the opposed convex outer faces 37A of the post 12. The convex outer faces in turn define a guide track along which the carriage 24 is able to slide by means of the rollers 32 and 34.

The pulley housing 16 is formed with a transverse mounting aperture 36 for detachably and pivotably mounting a pair of footrests 40 and 42. As is shown in FIG. 2, a stub axle 44 extends from the footrest 40, and is arranged to be passed through the mounting aperture 36, with the free end of the axle 44 being twisted into locking engagement with a complemental aperture 46 formed in the footrest 42. Both of the footrests 40 and 42 have non-slip rubberised planar lower surfaces 47 for preventing slippage when they are stood upon. Each footrest is also ring-shaped in form, with central rectangular apertures 48 defining handgrips 49 for allowing the individual footrests to be gripped by the hands for performing particular exercises.

The end connector 20 is formed with a clevis formation 52 defining a pair of transverse mounting apertures 36A and 36B for mounting an identical pair of footrests 40A and 42A. The footrests are completely interchangeable with the result that the exercise apparatus may be provided with a single pair of footrests which may be switched from one end of the post to the other, depending on which exercise is being performed.

Turning now to FIG. 3, the double spigot joint 14.1 comprises an intermediate collar 54 from which opposed spigot sections 56A and 56B extend. Each of the spigot sections is formed with a U-shaped channel 58 defining resilient connectors 60 terminating in studs 62 and 62A. Each of the spigot sections 56A and 563 is arranged to form a snug fit within the openings 64 defined within the tube sections 12.1 and 12.2. When the spigot section 56B is fully inserted within the opening 64, the stud 62 forms a snap fit within a complemental aperture 66 formed through the tube section 12.1. The ends of four elastic bands 68, 70, 72 and 74 extend through the opening 64, and terminate in respective connection pieces 68A, 70A, 72A and 74A which are swaged to the ends of the elastic bands. Each connection piece has an intermediate neck portion 73 terminating in a head portion 80. The head portions of the connection pieces are pushed into openings defined in the spigot section 56B until a shoulder ring 82 abuts against the openings in the spigot section 56B. Cylindrical locking pins 84 and 86 are passed through respective circular apertures 88 and 90 formed in the spigot section 56B and extend downwardly into the gaps 92 defined between the neck portions 78 as to anchor the connector pieces firmly in position. The stud 62A similarly forms a snap fit within all aperture in the tube section 12.2, and the tube sections 12.1 and 12.2 are detachably connected by means of the double spigot connector 14.1. The tube sections 12.2 and 12.3 are likewise detachably connected by means of a similar double spigot connector 14.2.

Referring new to FIG. 4, the pulley housing 16 is shown mounted firmly to the upper end of the post section 12.1. A pulley axle 94 is mounted to opposite end walls of the pulley housing 16, and carries four pulleys 96 around which the elastic bands 68, 70, 72 and 74 pass. These elastic bands extend through four corresponding apertures 98 formed in a recessed bearing plate 100, and terminate in connection pieces 102 which are similar to the connection pieces 68A to 74A at the opposite anchored ends of the elastic bands. Each connection piece 102 is formed with a shoulder ring 103 at its base which prevents the connection piece from slipping through the smaller diameter apertures 98. The connection pieces are also formed with rounded neck portions 104 terminating in head portions 106.

Referring now to FIG. 5, a selector mechanism 108 comprises a round cylindrical anchoring shaft 110 which is journalled to opposite wall of an anchoring shaft housing 112 illustrated in FIG. 2 and forming part of the carriage 24. The anchoring shift 110 has a pentagonal handle 113 fixed to one end with five facets 114 numbered from 0 to 4. An indexing ratchet 116 is mounted to the opposite end of the anchoring shaft 110, and engages with a sprung pawl 118 for allowing the anchoring shaft 110 to be turned only in a clockwise direction by means of the handle 113 and maintains the shaft in a position so as to prevent counter-rotation and release of the elastic bands. The anchoring shaft 110 is formed with four half round release grooves 120A, 120B, 120C and 120D dimensioned to clear the heads 106 on the connector pieces 102. The grooves 120A to 120D are progressively radially offset relative to one another by approximately 70°.

The number of elastic bands which are connected to the carriage 24 are varied when the elastic bands 68, 70, 72 and 74 are retracted and the carriage is in its uppermost position against the planar land 18 of the pulley housing 16. In this position, the four connection pieces 102 which extend from the pulley housing protrude into four corresponding apertures 121 formed in the anchoring shaft sub-housing 112. The connection pieces are brought into selective engagement with the rounded anchoring shaft surface in the following manner. In the position indicated in FIG. 5, which corresponds to a "1" reading on the handle, the elastic band 68 is engaged with the anchoring shaft 110 by virtue of the rounded outer surface of the anchoring shaft engaging with the complementally profiled concave neck 104. In this position, the heads 106 on the remaining elastic bands 70, 72 and 74 are cleared from engagement with the anchoring shaft by the complemental half round release grooves 120C, 120B and 120A.

If the anchoring shaft is now rotated clockwise to position 2, as is determined by the indexing ratchet 116, the release groove 120C is moved out of coaxial alignment with the head 106 of the connection piece of the second elastic band 70, with the result that the rounded anchoring surface engages the neck portion 104 of the second band 70. Progressive rotation of the anchoring shaft will result in the release grooves 120B and 120A being progressively moved out of alignment with the heads 106 of the respective bands 72 and 74, and corresponding engagement of the connector pieces 102 on the bands 72 and 74 in the "3" and "4" positions. In the "0" position, all of the release grooves are aligned with the heads, with the result that the entire carriage can be disengaged from the elastic bands to slide freely along the post 12.

The rotary selector mechanism allows the user to select the number of elastic bands required in a quick and easy manner, thereby providing a suitable resistance for the exercise that is to be performed and the strength of the person exercising.

Furthermore, the number of exercises may be varied by adjusting the length of the post 12. In the full length position illustrated in FIGS. 1 and 2, the extended distance between the handlebars 26 and 28 and the footrests 40A and 42A is approximately 1.23 m. This allows exercises such as inclined leg presses, standing and seated hip flexors, lat, reverse-grip and straight arm pull downs, shoulder presses, front raises and different types of curls to be performed.

The length of the post 12 can easily be adjusted by removing the 0.5 m intermediate or extension tube section 12.2 and by attaching the first upper tube section 12.1 directly to the lower tube section 12.3 by means of the double spigot joint 14.1. This allows other exercises, such as seated calf raises, seated rows, chest flys, bent arm pull-downs and hip adductor and abductor exercises to be performed more appropriately with the shortened post which provides a shortened extended handlebar-to-footrest distance of 0.73 m.

Referring now to FIGS. 7 and 8, a base plate assembly 122 comprises a rectangular platform 123 having a raised portion 124, the upper surface of which is fitted with a pair of mounting blocks 126 for accommodating a pair of footrests 40A and 42A in the manner illustrated in FIG. 8. One end of a bracing arm 128 is fitted into a complemental rectangular aperture 130 formed in the raised portion. The bracing arm 128 is formed with a horizontal limb 132 and an upwardly angled support arm 134 at the end of which is located a clamping formation 136. As is clear from FIG. 7A, the clamping formation 136 has a U-shaped bracket 138 to which a double hinged clamping latch 140 is attached. A locking wedge 141 extends from the latch and fits into a complemental wedge-shaped recess 141A. A U-bolt 142 is fixed to the platform 122, and carries a pulley 144. A pull cable 146 is passed around the pulley 144, and snap hooks or karabiners 148 and 148A are fitted to opposite ends of the cable 146.

Various attachments are provided for the pull cable, including a handle bar 150 carrying a pair of handles 152, an adjustable wrist or ankle strap 154 and an individual handle 156. Various apertures 130, 156A, 158, 160 and 161 are formed in the raised portion for accommodating the various components described above when the apparatus is in the stowed position. The elongate aperture 160 is also provided for retaining the intermediate tube section 12.2, which has numbered graduations 162 formed along its length, as is clear from FIG 8. When positioned within the aperture 160, the graduated section may be used to measure the suppleness of an exerciser seated with his or her feet against the raised section 124.

Referring now to FIG. 8, the bracing arm 128 is shown in a deployed position, in which it is located within a slot (not shown) extending into the rear face of the raised section 124. A footrest 166 on the bracing arm allows it to rest firmly on the ground. The clamping formation 136 is rotated from an inoperative position through 90° to an operative position in which it is ready to receive the intermediate tube section 12.2. The clamping lamb 140 is then folded around the post into a closed position in which it holds the post firmly in position. It can clearly be seen from FIG. 8 how the locating blocks 126 fit snugly through the apertures 48 in the footrests 40A and 42A so as to allow the exercising apparatus to adopt a free standing position.

Once the post is mounted in position, the map hook 148A at one end of the pull cable is passed through an aperture 168 formed in the carriage, and a suitable attachment such as the cross-bar 150 is fitted to the opposite snap hook 148. It is now possible for the exerciser to stand on the platform 122 and to perform various exercised by exerting a pulling force on the pull cable 146. Hooks 170 at spaced intervals along the pull cable allow the effective length of the cable to be effectively varied depending on the exercise that needs to be performed. Alternatively, separate cable lengths may be provided for performing different exercises, with hooks being provided at the ends of the cable lengths. The ankle and hand straps 154 and 156 may be fixed to any one of the hooks. As in the previous embodiments, the resistance may be varied by bringing the carriage 24 into contact with the pulley housing 16 and rotating the handle to a desired position.

Figure 9:
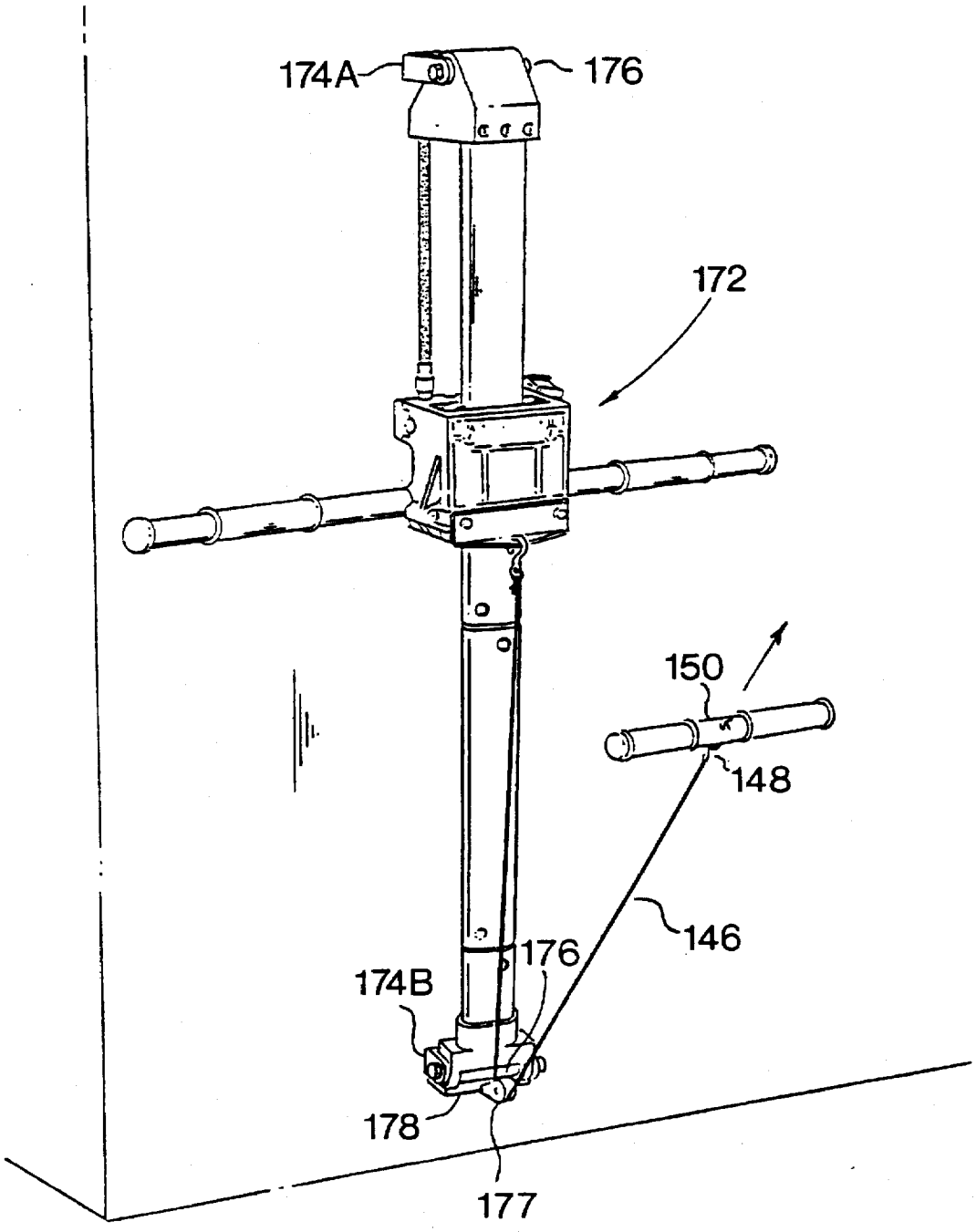
FIG. 9 shows a third wall-mounted embodiment of an exercise apparatus of the invention.

Referring now to FIG. 9, a wall-mounted embodiment 172 of the exercise apparatus is shown in which U-shaped brackets 174A and 174B are used to mount opposite ends of the exercise apparatus to a wall by passing pins 176 through the mounting apertures 36 and 36A. A pulley 177 is supported on a mounting flange 178 extending from the bracket 174B. The wall mounted embodiment is used in a similar manner as the free standing embodiment of FIGS. 7 and 8, save that there is no need for the carrier to stand on a base platform to stabilise the apparatus.

Figure 10:
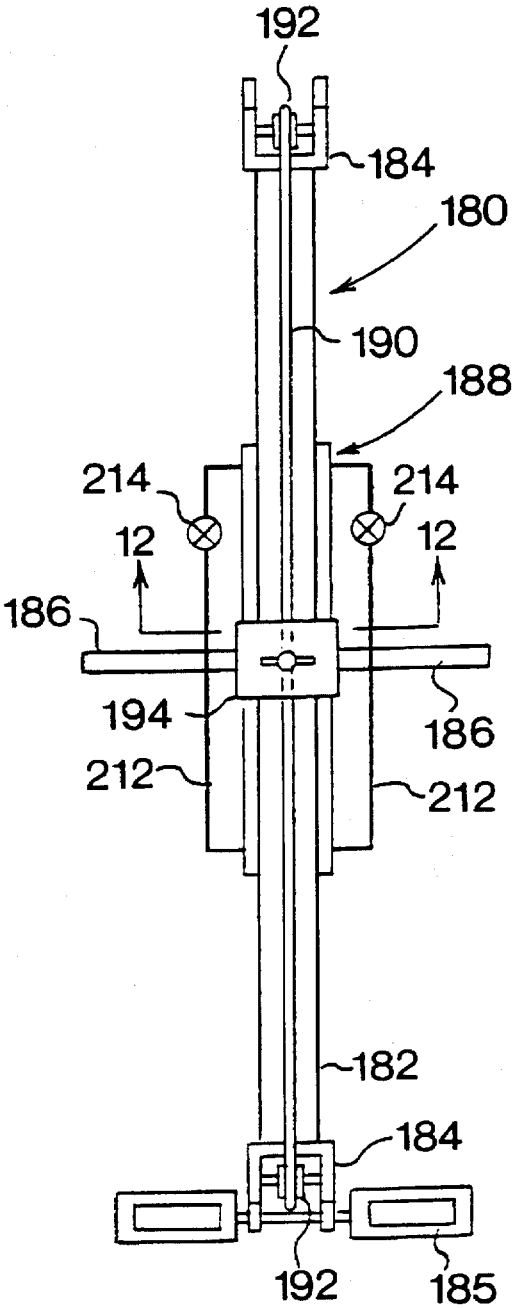
FIG. 10 shows a front view of an hydraulic embodiment of an exercise apparatus of the invention.
Figure 11:
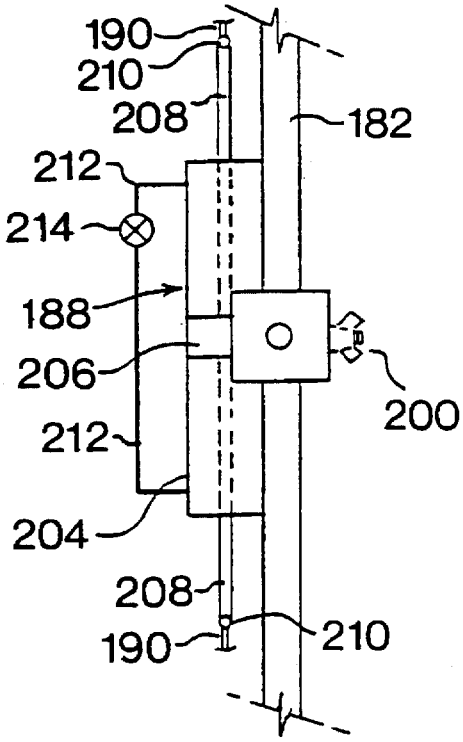
FIG. 11 shows a side view of part of the exercise apparatus of FIG. 10.
Figure 12:
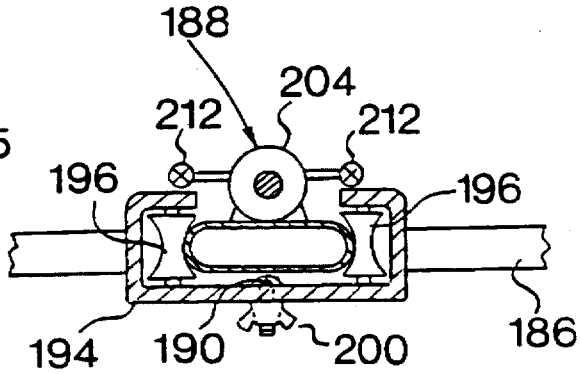
FIG. 12 shows a cross-section on the line 12—12 of FIG. 10.

FIGS. 10 to 12 show an alternative embodiment of an exercising apparatus 180 comprising a post 182 having a stop and connector member 184 at either end, at least one pair of footrests 185 detachably mountable to either of the connector members, a pair of handlebars 186 slidably guided for movement along the post 182, and a double acting piston and cylinder assembly 188. A steel cable 190 connects the handlebars to the piston and cylinder assembly 188. The post and stop formations and the footrests may be similar in construction to those illustrated in the previous embodiment, in which case a single pulley 192 is required at each end.

The handlebars 186 extend transversely from a carriage 194 which is C-shaped in cross-section and which supports four guide rollers 196. A quick release cable clamp 200 is carried on the carriage 194, and may be in the form of a wing nut for releasably engaging the cable 190 at any selected position.

The piston and cylinder assembly 188 comprises a sealed cylinder 204, a piston 206 and two piston rods 208 attached to opposite sides of the piston and passing through opposite ends of the cylinder in scaling engagement with the cylinder. The cable 190 is connected to the free ends of the rods 10. A pair of pipes 212 communicate with each of the chambers formed in the cylinder on either side of the pistons as to allow hydraulic fluid to pass between the chambers. The flow of fluid through each pipe is controlled by a one way adjustable valve 214 so as to allow resistance to movement of the piston in either direction along the cylinder to be varied by the user as desired.

Figure 13:
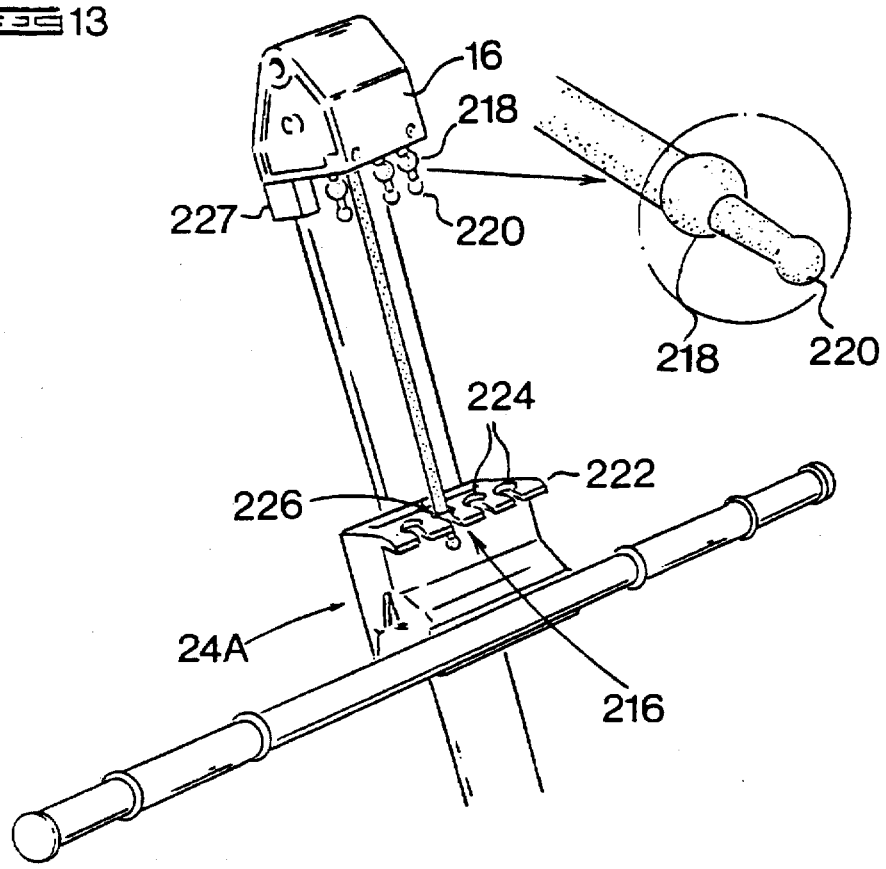
FIG. 13 shows a perspective view of an alternative embodiment of selector means.

Referring now to FIG. 13, an alternative embodiment of a selector means 216 is shown. Each of the elastic bands is formed with integral bulbous heads 218 from which gripping tabs 220 extend. The carriage 24A is fitted with a connector plate 222 having four keyhole dots 224 corresponding to the four heads 218. The carriage 24A is brought up against the pulley housing 16 and a selected number of elastic bands are engaged with the carriage by gripping the tab formation 220 of a chosen band and passing the elastic band through the corresponding keyhole slot 224 so that the head 218 is held captive on the underside of the connector plate surrounding the keyed slot, as is shown at 226. A stop formation 227 extends from the pulley housing so as to provide sufficient spacing between the pulley housing and the carriage for allowing, the tab formations to be gripped. Although less convenient than the rotary selector embodiment, this embodiment is relatively cheap and simple to manufacture. Further, if the tensions in the individual elastic bands are varied, a large number of different tensions (up to 24) may be obtained by selecting different combinations of elastic bands.

Figure 14:
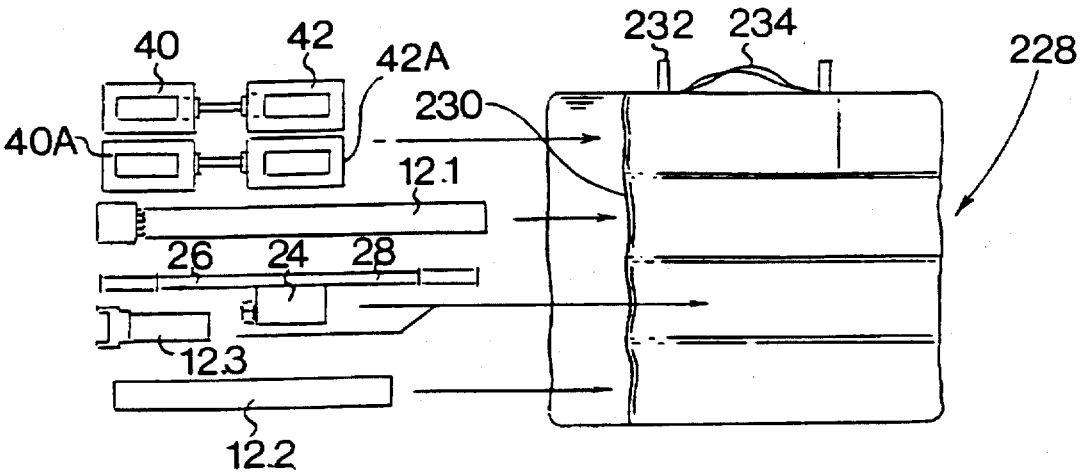
FIG. 14 shows the first embodiment of the exercise apparatus in the stowed position.

In FIG. 14, the exercise apparatus of FIGS. 1 and 2 is shown in a disassembled form and about to be stowed away into a carrying bag 228. It can clearly be seen from FIG. 14 how the various components can be disassembled in such a way that they all have a substantially elongate linear form, as a result of which they can be snugly fined into complemental elongate compartments 230 formed in the bag. Once the various components have been fitted into the bag, the bag is rolled up and secured in a compact and portable form using straps 232. The entire exercise apparatus weighs approximately 3.5 kg, with the result that the bag 228 can easily be carried around on a carrying handle 234 when travelling and the like. The carrying bag 228 is padded, with the result that it can double as an exercise mat upon which the various exercises can be performed.

We claim:

1. An exercise apparatus comprising an elongate spacer element having first and second ends, guide means extending along the length of the spacer element, a carriage mounted slidably to the spacer element for movement between the first and second ends along the guide means, at least one handlebar supported on the carriage, resistance means for applying a resistive force against movement of the carriage as it is displaced long the spacer element in a first direction, the resistance means comprising a plurality of elastic resistance elements extending between the carriage and a fixture on the spacer element, varying means for varying the resistance of the resistive force, and anchoring means mountable to either of the first and second ends for enabling either a pushing or a pulling force to be applied to the handlebar against the variable resistive force when moving the carriage in the first direction characterised in that selector means are mounted on the carriage for selectively engaging with or disengaging from the carriage a preselected number of resistance elements, the anchoring means include at least one footrest extending transversely relative to the spacer element from whichever of the first and second ends is selected, and the footrest or footrests define a pivot axis and are arranged to provide a temporary anchoring support against movement of the handlebar when the feet of a user are positioned over the footrest or footrests, so as to allow the elongate spacer element to pivot in a substantially vertical plane about the pivot axis at its first or second ends, as the handlebar is moved in the first direction against the variable resistive force.

2. An exercise apparatus according to claim 1 in which the selector means comprising an anchoring shaft which is mounted movably within the carriage, indexing means for indexing movement of the shaft, and disengaging and engaging formations extending along the length of the shaft for selectively disengaging or engaging the movable ends of the resistance elements as the shaft is moved.

3. An exercise apparatus according to claim 2 in which the anchoring shaft is mounted rotatably within the carriage, the indexing means indexes rotary movement of the shaft, and the disengaging and engaging formations are radially offset along the length of the shaft.

4. An exercise apparatus according to claim 3 in which the radially offset disengaging formations comprise a series of release grooves extending transversely relative to the axis of the anchoring shaft, and each of the movable ends of the resistance elements terminate in a head, with a narrowed neck portion being located rearwardly of the head, and being dimensioned to be anchored by the shaft, each head and release groove being complementally dimensioned such that a particular head is released on rotation of the corresponding release groove into axial alignment with the head.

5. An exercise apparatus according to claim 1 in which said at least one footrest comprises a pair of footrests which is pivotably mounted to the spacer element on a pivot axle so as to allow the spacer element to pivot freely in the vertical plane when supported on the stationary pair of footrests, the footrests having a major uniplanar lower gripping surface for frictional engagement with a floor or the like and a major upper surface for supporting the feet of an exerciser, whereby the mass of the exerciser maintains the frictional engagement so as to anchor the footrests in position.

6. An exercise apparatus according to claim 5 in which each footrest in the pair of footrests is formed with at least one central recess so as to define a pair or elongate outer handgrips on either side of the recess.

7. An exercise apparatus according to claim 6 in which the pair of footrests includes a central pivot axle joining each footrest, with each footrest being in the form of a rectangular ring defining the pair of handgrips.

8. An exercise apparatus according to claim 1 in which the fixture comprises anchoring means located remotely relative to an end of the spacer element for anchoring fixed ends of the resistance elements, and a pulley assembly is located towards the first end of the spacer element, the pulley assembly including a pulley housing, a plurality of pulleys mounted rotatably within the housing and a plurality of apertures defined in the housing through which movable ends of the resistance elements are presented for selective engagement with the selector means when the carriage is brought to bear against the housing.

9. An exercise apparatus according to claim 1 in which the support comprises a base plate assembly for allowing the exercise apparatus to be used in a substantially rigid free standing slanting position, the base place assembly including a platform arranged to support an exerciser and mounting means for mounting the exercise apparatus in the free standing position.

10. An exercise apparatus according to claim 9 in which the mounting means comprises a footrest mounting formation for detachably mounting the footrest or footrests, and a stabilising arm extending from the platform and terminating in a clamping formation for clamping around the spacer element so as to hold it in the free standing slanting position.

11. An exercise apparatus according to claim 1 in which the spacer element comprises a hollow post formed from a plurality of tube sections, and connector means for detachably mounting together the tube sections, whereby the length of the post may be varied for enabling different exercises to be performed by selecting the number of tube sections making up the post.

12. An exercise apparatus according to claim 9 which includes a pull cable terminating in a handle, pull cable mounting means for mounting a fixed end of the pull cable to the carriage, and pulley means carried on the base plate assembly around which the pull cable is arranged to pass.

13. An exercise apparatus according to claim 5 in which pairs of footrests are mounted pivotably to both the first and second ends of the elongate spacer element.

14. An exercise apparatus according to claim 1 in which the selector means comprises a series of slot formations extending from the carriage, and each of the resistance elements terminates in an integrally formed bulbous head from which a gripping tag extends for selectively engaging at least one of the heads behind a corresponding slot formation.

* * * * *